US008714849B2

(12) United States Patent
Moore

(10) Patent No.: US 8,714,849 B2
(45) Date of Patent: May 6, 2014

(54) INTELLIGENT RIBBON CARTRIDGE

(75) Inventor: Kevin P Moore, Irvine, CA (US)

(73) Assignee: Printronix, Inc., Irvine, CA (US)

( * ) Notice: Subject to any disclaimer, the term of this patent is extended or adjusted under 35 U.S.C. 154(b) by 282 days.

(21) Appl. No.: 13/009,272

(22) Filed: Jan. 19, 2011

(65) Prior Publication Data

US 2011/0176850 A1 Jul. 21, 2011

Related U.S. Application Data

(60) Provisional application No. 61/296,247, filed on Jan. 19, 2010.

(51) Int. Cl.
*B41J 35/28* (2006.01)

(52) U.S. Cl.
USPC ..... 400/208; 400/76; 400/207

(58) Field of Classification Search
USPC ..... 400/207
See application file for complete search history.

(56) References Cited

U.S. PATENT DOCUMENTS

| | | | | |
|---|---|---|---|---|
| 4,609,422 | A | 9/1986 | Becking | |
| 4,797,018 | A | 1/1989 | Hofmann et al. | |
| 4,803,521 | A * | 2/1989 | Honda | 399/12 |
| 4,926,193 | A | 5/1990 | Berson et al. | |
| 5,215,391 | A | 6/1993 | Daley et al. | |
| 5,410,641 | A * | 4/1995 | Wakabayashi et al. | 358/1.13 |
| 5,411,339 | A * | 5/1995 | Bahrabadi et al. | 400/208 |
| 5,615,958 | A | 4/1997 | Furrow et al. | |
| 5,699,091 | A * | 12/1997 | Bullock et al. | 347/19 |
| 6,012,860 | A | 1/2000 | Nunokawa et al. | |
| 6,767,147 | B2 * | 7/2004 | Jakubowski et al. | 400/207 |
| 6,798,434 | B2 | 9/2004 | Shibata et al. | |
| 6,830,391 | B2 * | 12/2004 | Clayvon et al. | 400/207 |
| 2003/0156877 | A1 | 8/2003 | Tischer | |
| 2007/0127936 | A1 | 6/2007 | Miller | |

OTHER PUBLICATIONS

Australian patent application No. 2011207606: office action dated Sep. 18, 2013.

* cited by examiner

*Primary Examiner* — Jill Culler
(74) *Attorney, Agent, or Firm* — Haynes and Boone, LLP

(57) ABSTRACT

In one embodiment, an intelligent printer ribbon cartridge includes a microcontroller that monitors sensors related to the ribbon cartridge for use in a line matrix printer. The ribbon cartridge contains an impact printing ribbon in the form of either a simple loop, a mobius loop, or a long strip of ribbon connected to two spools, with one spool at each end of the cartridge. The ribbon cartridge is able to monitor at least one motion sensor, process the information, and perform a suitable action or communicate an action or information to the printer. This allows the ribbon cartridge to adapt or instruct the printer to adapt with any new types of ribbons, ribbon cartridges, formats, etc. so that the printing may occur with virtually any type of ribbon/cartridge.

20 Claims, 4 Drawing Sheets

INTELLIGENT RIBBON CARTRIDGE

CROSS REFERENCE TO RELATED APPLICATIONS

The present application claims priority to U.S. Provisional Application Ser. No. 61/296,247, filed Jan. 19, 2010, which is incorporated by reference in its entirety.

BACKGROUND

1. Field of the Invention

The present invention generally relates to printer ribbon cartridges.

2. Related Art

Printers are used in a variety of applications and many of them require special ribbons and inks. The problem is that every time a new ribbon cartridge is created other things need to change in the printer which makes the older printers no longer compatible with the newer ribbon cartridges. In the past, attempts have been made to save parameters in the ribbon cartridge to inform the printer how to behave but this approach is limited because many times complete algorithms need to change and sometimes even the physical sensors need to change. These changes are not able to be accomplished by simply sending parameters from the ribbon cartridge back to the printer.

The problem that needs to be overcome is how to be able to introduce new ribbon cartridges that are compatible with the earlier printers. Since many of the special ribbon requirements come from new customer needs, it is desirable to respond to those needs without coming out with a completely new printer that would require agency approvals. As more and more countries come out with their own agency requirements, they deter smaller volume specialty equipment from being sold in those regions because the cost of going through the agency tests may be higher than the profit to be made by selling the equipment.

SUMMARY

According to one embodiment, an intelligent printer ribbon cartridge includes a processor, microcontroller, or the like that monitors sensors related to the ribbon cartridge for use in a line matrix printer. The ribbon cartridge contains an impact printing ribbon in the form of either a simple loop, a mobius loop, or a long strip of ribbon connected to two spools, with one spool at each end of the cartridge. The ribbon cartridge is able to monitor at least one motion sensor, process the information, and perform a suitable action or communicate an action or information to the printer. This allows the ribbon cartridge to adapt or instruct the printer to adapt with any new types of ribbons, ribbon cartridges, formats, etc. so that the printing may occur with virtually any type of ribbon/cartridge.

In one embodiment, the processor has the intelligence to know if the ribbon is moving in the proper manner for the type of cartridge. The ribbon cartridge is able to communicate with the printer to inform the printer of any problems with the motion of the ribbon. The motion sensor that the processor monitors can be either a magnetic sensor, and optical sensor or a mechanical brush that makes contact with contacts on a wheel that rotates as the ribbon rolls over it.

In another embodiment, the intelligent ribbon cartridge monitors a sensor that detects the weld where the two ends of the ribbon are attached to each other to create either a loop or a mobius loop. The processor is able to detect the weld for the given environment. This includes the technology used in the weld sensor, e.g., transmissive optical or reflective optical, an electrical contact using either a conductive material on the physical ribbon, or a hole in the ribbon that allows an electrical contact to be made through the ribbon. The intelligent ribbon cartridge communicates with the printer and informs the printer that the ribbon weld has been detected and that the printer should stop printing until the weld has gone past the printing mechanism.

In another embodiment, the ribbon cartridge is able to detect the type of printer that it is attached to so that the information can be made compatible for the particular printer. For example, the processor may be able to convert information about the ribbon to a language or format that the printer can understand. This allows the ribbon cartridge to adapt to the printer instead of the printer adapting to the cartridge.

In another embodiment, the intelligent ribbon cartridge contains a ribbon attached to two spools, one at either end of the ribbon, with the ribbon wrapped around one or both of the spools. The processor monitors sensors that detect when the ribbon has reached the end of the spool and it is time for the direction to be reversed. The processor is able to detect the end of the ribbon for the given environment. This includes the technology used in the ribbon end sensor, e.g., transmissive optical or reflective optical, an electrical contact using either a conductive material on the physical ribbon, or a hole in the ribbon that allows an electrical contact to be made through the ribbon. The processor communicates with the printer and informs the printer that the ribbon has reached the end of the spool and that the printer should reverse the direction of the printing.

Additionally, in one embodiment, all communications to and from the printer is performed over a single wire. This reduces the number of electrical contacts needed and therefore reduces cost and increases reliability. Also through a single wire, different information related to different sensors can be sent to the printer. Furthermore, by sending commands to the printer, the ribbon cartridge controls the printer instead of the printer controlling the cartridge.

These and other features and advantages of the present invention will be more readily apparent from the detailed description of the embodiments set forth below taken in conjunction with the accompanying drawings.

Figure 1:
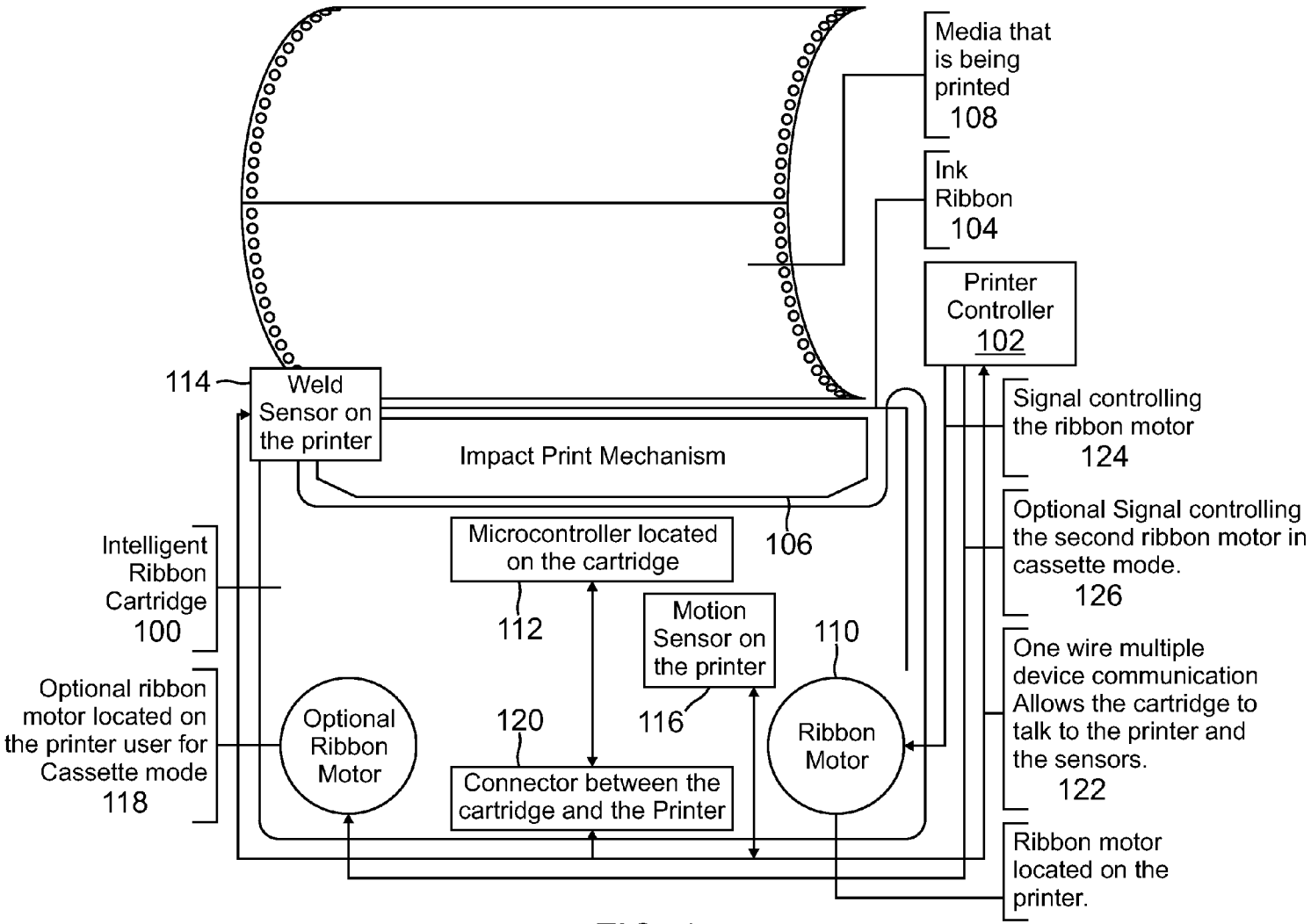
FIG. 1 is a block diagram of an intelligent ribbon cartridge used in a printer system according to one embodiment.

Embodiments of the present disclosure and their advantages are best understood by referring to the detailed description that follows. It should be appreciated that like reference numerals are used to identify like elements illustrated in one or more of the figures, wherein showings therein are for purposes of illustrating embodiments of the present disclosure and not for purposes of limiting the same.

DETAILED DESCRIPTION

In various embodiments, the intelligence needed to handle different types of ribbons or cartridges is moved from the printer and into the physical ribbon cartridge. This is accomplished, in one embodiment, by placing a processor or microcontroller inside the ribbon cartridge, which allows new ribbon cartridges to behave in the same or similar manner as older ribbon cartridges.

In one embodiment, a processor within a ribbon cartridge monitors one or more sensors inside or outside the cartridge. The processor processes information from the one or more sensors and takes an appropriate action. Depending on the information, the processor may change one or more operating parameters of the ribbon, communicate an event to the printer, communicate a suggestion or action to the printer, convert language or format to one that is acceptable to the printer, etc. This can be done through a single wire or other communication means (including wirelessly) to a printer controller.

FIG. 1 is a block diagram showing an intelligent ribbon cartridge 100 in communication with a printer controller 102 as part of a printer system. In this embodiment, the printer system is an impact printer and more specifically a dot matrix printer. Note that in other embodiments, different printer types may be suitable. Ribbon cartridge 100 contains a print ribbon 104 that passes between an impact print mechanism 106 and print media 108, such as paper. Impact print mechanism 106 may include hammers or other impact mechanisms for transferring letters, symbols, numbers, or characters onto print media 108. A ribbon motor 110 moves ribbon 104 through ribbon cartridge 100.

A processor or microcontroller 112 is located within or on ribbon cartridge 100. Microcontroller 112 can be any suitable processor or computing device that can perform the functions described herein. In particular, microcontroller 112 monitors one or more sensors in the ribbon cartridge or on the printer, processes information from the sensors, and communicates information to printer controller 102 and/or controls an action or function within ribbon cartridge 100.

The sensors may be located at various locations in, on, or outside ribbon cartridge 100. In the embodiment of FIG. 1, a weld sensor 114 is located on the printer, which senses when a weld on ribbon 104 appears. Weld sensor 114 is placed at a location outside the cartridge and before the ribbon passes through impact print mechanism 106. Thus, weld sensor 114 is able to detect a ribbon weld before it is impacted by impact print mechanism 114. As is known, a ribbon weld is the location where a length of ribbon is attached to itself to create a loop. Conventional weld sensors are known and any suitable sensor may be used to detect the weld on the ribbon. Ways to detect a weld include, but are not limited to, transmissive optical or reflective optical, an electrical contact using either a conductive material on the physical ribbon, or a hole in the ribbon that allows an electrical contact to be made through the ribbon.

When the weld is detected by weld sensor 114, a signal is communicated to microcontroller 112, which can then instruct the printer, via printer controller 112, to stop printing until the weld passes impact print mechanism 106. This may be achieved by microcontroller 112 calculating when the printer should start printing again based on the speed of the ribbon and the length of impact print mechanism 114 (i.e., the amount of time it takes for the weld to pass the other end of impact print mechanism 114). Alternatively, another weld sensor may be located on the other side of impact print mechanism 114, which detects when the weld passes. This information is conveyed to microcontroller 112, which then informs the printer, via printer controller 102, to continue printing.

A motion sensor 116 may also or alternatively be located on the printer to detect motion of ribbon 104. Such motion sensors are known and any suitable motion sensor may be used. For example, a sensor to detect a magnet or piece of iron metal located on an idler pulley can be used to detect the motion of the ribbon. Different types of motion sensors include, but are not limited to, a magnetic sensor, an optical sensor, or a mechanical brush that makes contact with contacts on a wheel that rotates as the ribbon rolls over it. Motion sensor 116 detects if ribbon 104 stops moving. If this occurs, motion sensor 116 sends a signal to microcontroller 112, which in turn, sends a signal to printer controller 102 to stop printing, notify the user, or other suitable action. In addition to communicating information to printer controller 102, microcontroller 112 may be able to control the direction and velocity of ribbon motor 110 and velocity and stop the printer from printing.

Microcontroller 112 is also able to detect the type of printer that it is attached to so that the information can be made compatible for the particular printer. For example, the processor may be able to convert information about the ribbon to a language or format that the printer can understand. This allows the ribbon cartridge to adapt to the printer instead of the printer adapting to the cartridge. For example, microcontroller 112 may be able to "read" information about the ribbon or cartridge, determine (e.g., from its memory) the type of ribbon/cartridge, and convert the language or format to what is acceptable by the printer system, where the type of printer system is known by microcontroller 112, such as through an automatic detection or user-inputted information.

Figure 4:
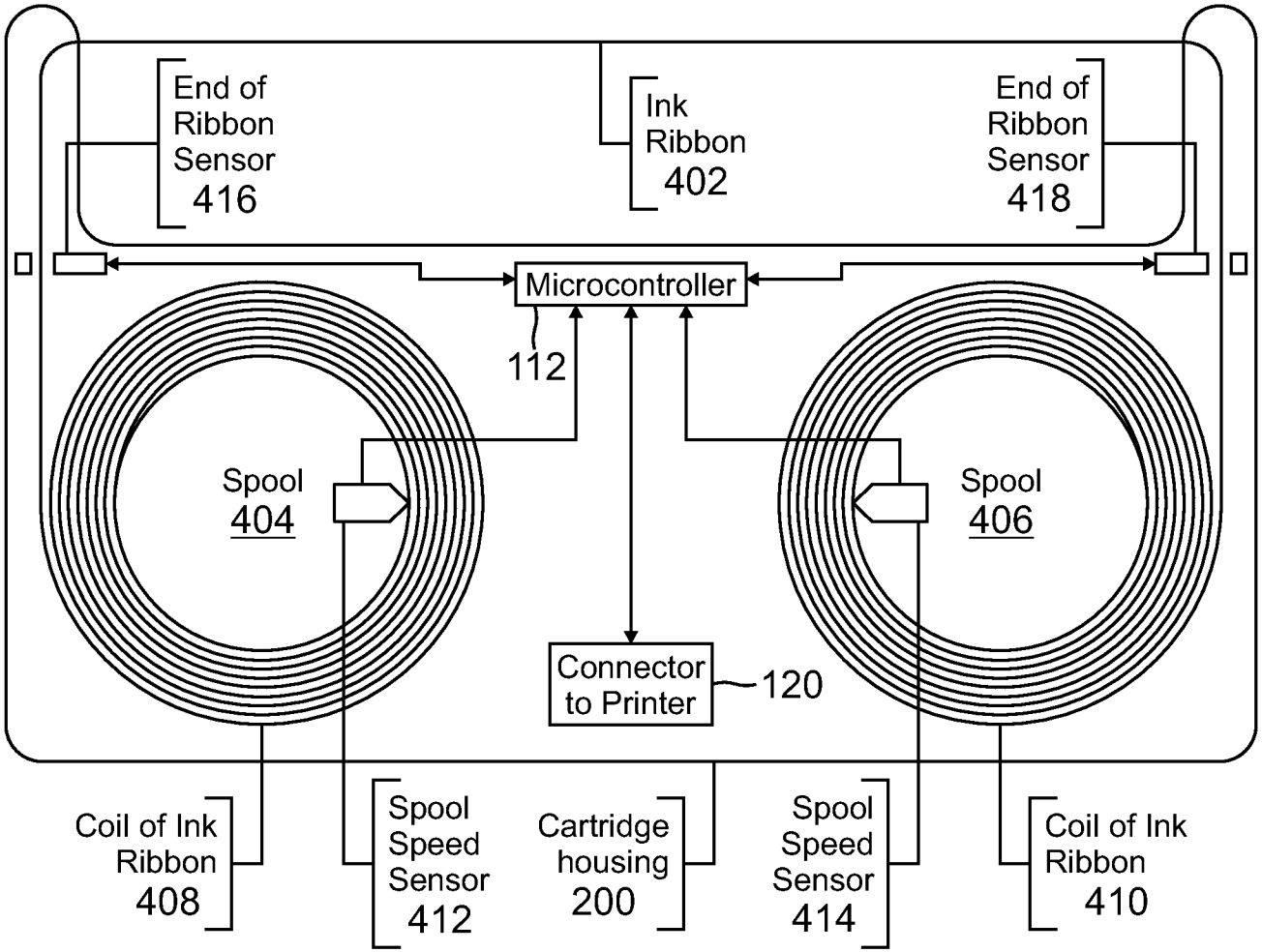
FIG. 4 is a block diagram of an intelligent ribbon cartridge using a ribbon wrapped around two spools at the ends of the cartridge according an embodiment of the invention.

Ribbon cartridge 100 may also include an optional second ribbon motor 118 for a different ribbon configuration, as well be discussed with respect to FIG. 4. Ribbon motor 110 and second ribbon motor 118 may be directly controllable by printer controller 102, such as by a direct connection 124 and 126, respectively, a common connection, wirelessly, or any other suitable control means. Printer controller 102 can stop, speed up, slow down, or start movement of the ribbon through ribbon motors 110 and/or 118, based on information received from microcontroller 112.

Microcontroller communicates with printer controller 102 through an interface or connector 120, where connector 120 can be located within, on, or outside ribbon cartridge 100. A single wire, line, or bus 122 carries signals between microcontroller 112 and printer controller 102 via connector 120. Note that in some embodiments, connector 120 is not needed, and line 122 carries signals directly between microcontroller 112 and printer controller 102. A single line reduces the number of electrical contacts needed and therefore reduces cost and increases reliability. Also through a single line, different information related to different sensors can be sent to the printer. Furthermore, by sending commands to the printer, the ribbon cartridge controls the printer instead of the printer controlling the cartridge. In other embodiments, multiple lines can be used, as well as wireless communication means.

By having a microcontroller on or in the ribbon cartridge to monitor and process signals from sensors, greater flexibility results in designing the ribbon cartridge. For example, different types of ribbon configurations can be used for a single printer, without the printer have to be changed. This is due to the microcontroller detecting events/changes and either controlling actions or informing the printer accordingly.

Figure 2:
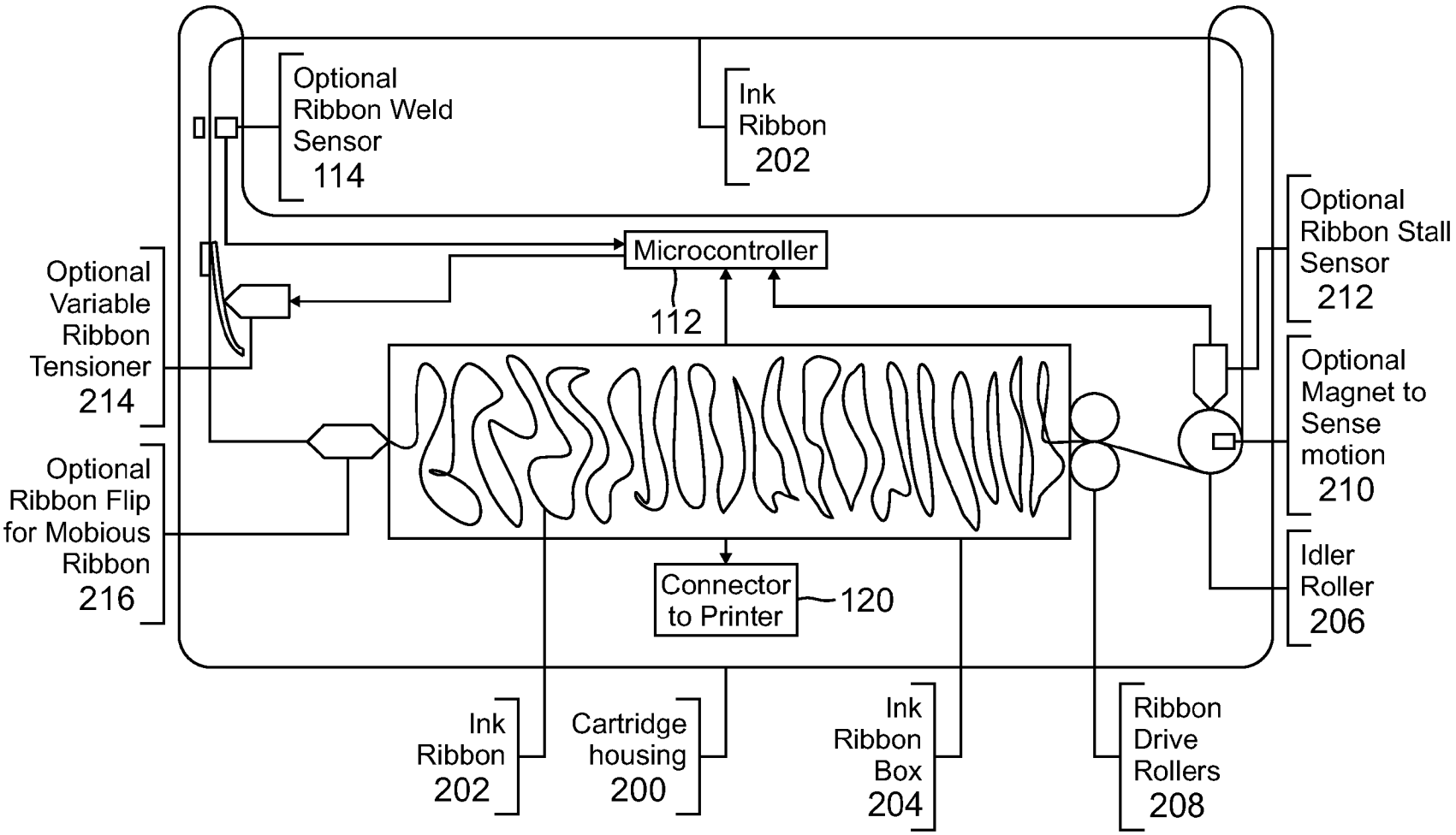
FIG. 2 is a block diagram of an intelligent ribbon cartridge using a continuous loop of ribbon in a box according an embodiment of the invention.

FIG. 2 shows one example of one type of ribbon configuration that can be used with the intelligent ribbon cartridge described above. In this example, the configuration is a mobius loop of ribbon 202 stuffed into a box 204, contained in a housing 200. This configuration also contains an idler pulley 206 that is used to detect ribbon motion. A sensor on the printer (not shown) may detect this motion from idler pulley 206. This information may be sent to microcontroller 112 for processing or communication as discussed above. Ribbon drive roller 208 pull ribbon 202 from box 204.

Ribbon weld sensor 114 may be located on the printer or cartridge housing 200. One advantage of having ribbon weld sensor on housing 200 is a reduction of the cost of the cartridge when a generic weld sensor is able to be used. The weld sensor information is sent to microcontroller 112 for processing or communication. For example, microcontroller 112 is able tell the printer to stop printing while the weld is going through the print station or active printer area and tell the printer to resume printing after the weld has passed the print station.

The ribbon cartridge may also include an optional magnet or other motion sensor 210 on idler puller 206 to detect motion of ribbon 202. Absence of motion or resumption of motion may be communicated to microcontroller 112 for appropriate processing or communication. If a motion sensor is also on the printer, only information from motion sensor 210 may be acted upon by microcontroller 112. An optional ribbon stall sensor 212 may also be present in the cartridge to detect when ribbon stalls, which again can be processed or communicated by microcontroller 112. Other possible elements include a variable ribbon tensioner 214 and a ribbon flip 216. Ribbon tensioner may be used to adjust tension in ribbon 202, based on information received and processed by microcontroller 112 or the printer. Ribbon flip 216 may be used for the mobius type ribbon.

In other embodiments, the intelligent cartridge may have many different variations such as having the ribbon not flip so that it is in a standard loop instead of a mobius loop, having the ribbon weld sensor inside the cartridge and ignoring the ribbon weld sensor that is located on the printer, and ignoring the ribbon weld altogether and printing on the weld as it passes through the print station.

Figure 3:
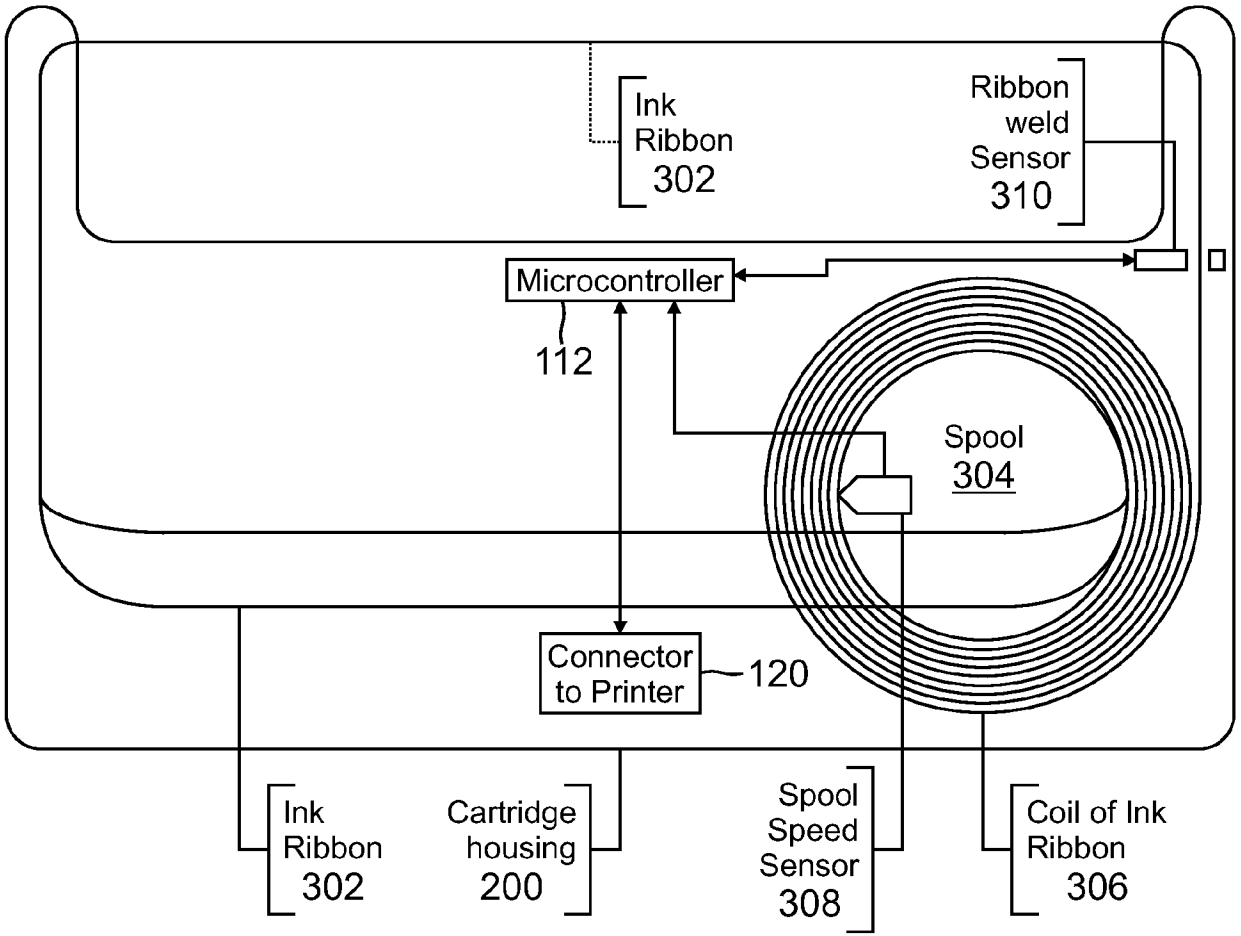
FIG. 3 is a block diagram of an intelligent ribbon cartridge using a ribbon wrapped around a single spool according an embodiment of the invention.

FIG. 3 shows another example of a different ribbon configuration according to another embodiment. In this example, an ink ribbon 302 is wrapped around a spool 304 forming a coil of ink ribbon 306. This type of arrangement is similar to what is used in old 8-track audio tapes, where ribbon 302 is wrapped around a single spool and pulled out of the center of the spool and returned by wrapping it around the outside of spool 304.

This configuration can still have all the different combinations of various elements described above, including having ribbon 302 in a mobius loop or not, a ribbon weld sensor 310 on the printer or part of the ribbon cartridge, having microcontroller 112 use the weld sensor on the printer or one with the cartridge (while ignoring the other if also present), ignoring the weld altogether (with or without weld sensors), a motion or speed sensor 308 on the printer or part of the ribbon cartridge, and adding a variable ribbon tension device that is controlled by the microcontroller on the cartridge.

FIG. 4 shows yet another example of a ribbon configuration according to one embodiment that can be used with the intelligent ribbon cartridge. Here, an ink ribbon 402 is wound and unwound between a first spool 404 at one end of cartridge housing 200 and a second spool 406 at another end of cartridge housing 200. This configuration is similar to what is used by cassette audio tapes, where ribbon 402 moves until it hits the end of one spool and then reverses until it hits the end of the other spool. For example, when ribbon 402 is at the end of spool 406, ribbon 402 forms a full coil of ribbon 408 around spool 404, and when ribbon 402 reaches the end of spool 404, ribbon 402 forms a full coil of ribbon 410 around spool 406. The process is continually repeated until the ribbon is out of ink.

Spools 404 and 406 typically each have a drive motor (not shown) or both have a single drive motor (not shown) with a clutch or transmission to switch the motor from spool to spool. A speed or motion sensor 412 is associated with spool 404 and another speed or motion sensor 414 is associated with spool 406. This enables the speed of ribbon 402 to be controlled from information received by microcontroller 112. A first ribbon sensor 416 is located at one end of the cartridge, and a second ribbon sensor 418 is located at the other end of the bridge to allow detection of an end-of-ribbon condition so that the ribbon can be properly reversed. For example, when the end of the ribbon is detected, information is processed or communicated by microcontroller 112, causing motors to reverse the direction of the spools.

Note that in this type of configuration, no weld sensor is needed because the ribbon is not welded into a single loop. Thus, there is no weld to detect, but rather when the ribbon ends at either of the two spools.

The above are just a few non-limiting examples. As can be seen, many different ribbon configurations can be used with an intelligent ribbon cartridge as described. These methods require different algorithms and sensors and not simply just different parameters to be passed back to the printer. This not only allows the algorithms to change but also the physical sensors as well. Since the intelligence of dealing with the ribbon sensors is now in the ribbon cartridge, physically moving the sensors is now possible inside the ribbon cartridge when the type of ribbon cartridge requires a special sensor. Additionally, the fundamental design of the ribbon cartridge is able to change.

Thus, older printers can accommodate new ribbon cartridges.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. For example, certain ribbon configurations have been described, but other types of configurations and for different types of printers may also be suitable where a ribbon cartridge is used for printing. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A ribbon cartridge, comprising:

a housing;

a ribbon contained in the housing and a microcontroller on or in the housing configured to receive information about a dynamically changing characteristic of the ribbon from a sensor, detect a type of printer, and automatically adapt the ribbon cartridge to the printer.

2. The ribbon cartridge of claim 1, wherein the microcontroller is on the ribbon cartridge and is further configured to process the information and control one or more components of the ribbon cartridge independent from the printer.

3. The ribbon cartridge of claim 1, wherein the microcontroller is configured to convert the information to a format compatible for the printer type.

4. The ribbon cartridge of claim 1, wherein the sensor is a motion sensor for the ribbon.

5. The ribbon cartridge of claim 4, wherein the sensor is located on or in the housing.

6. The ribbon cartridge of claim 1, wherein the microcontroller is configured to receive information about a characteristic of the ribbon from a second sensor.

7. The ribbon cartridge of claim 1, wherein the characteristic is a location of a weld on the ribbon.

8. The ribbon cartridge of claim 1, wherein the characteristic is a motion of the ribbon.

9. The ribbon cartridge of claim 1, wherein the microcontroller is adapted to receive information from a plurality of different ribbon configurations.

10. The ribbon cartridge of claim 9, wherein the ribbon configurations comprise a mobius loop, a cassette-type, and an 8-track type.

11. The ribbon cartridge of claim 1, wherein the microcontroller is further configured to send commands to a printer controller, based on processing of the information about the dynamically changing characteristic of the ribbon to control a printer using the ribbon cartridge.

12. The ribbon cartridge of claim 11, wherein the commands are sent through a single wire.

13. A method of operating a printer system, comprising:

sensing, by a sensor, information about a dynamically changing characteristic of a ribbon in a ribbon cartridge from a plurality of different ribbon configurations;

detecting a type of printer;

communicating the information and the type of printer to a microcontroller in or on the ribbon cartridge; and automatically adapting the ribbon cartridge to the printer.

14. The method of claim 13, wherein the sensing comprises detecting motion of the ribbon.

15. The method of claim 13, wherein the sensing comprises detecting when a weld on the ribbon is about to pass through a printing area and when the weld passes the printing area.

16. The method of claim 13, further comprising converting the information to a format compatible with the printer system.

17. The method of claim 13, wherein the ribbon configurations comprise a mobius loop, a cassette-type, and an 8-track type.

18. The method of claim 13, wherein the microcontroller processes information from multiple sensors.

19. The method of claim 13, further comprising:

processing, by the microcontroller, the information;

controlling a component in or on the ribbon cartridge; and sending commands, based on the processing, by the microcontroller, to a printer.

20. The method of claim 19, wherein the sending is through a single wire.

* * * * *